US005540178A

United States Patent [19]

Damron

[11] Patent Number: 5,540,178

[45] Date of Patent: Jul. 30, 1996

[54] RECREATIONAL AND EMERGENCY LADDER FOR WATERCRAFT

[76] Inventor: Janet K. Damron, P.O. Box 62, Clawson, Utah 84516

[21] Appl. No.: 452,953

[22] Filed: May 30, 1995

[51] Int. Cl.[6] ..... B63B 17/00

[52] U.S. Cl. ..... 114/362; 182/196; 441/39

[58] Field of Search ..... 114/362; 441/39; 182/196, 76, 70

[56] References Cited

U.S. PATENT DOCUMENTS

| | | | |
|---|---|---|---|
| 686,182 | 11/1901 | Wright | 182/196 |
| 4,788,926 | 12/1988 | Ullman et al. | 114/362 |
| 4,811,817 | 3/1989 | Geary | 182/76 |
| 5,074,236 | 12/1991 | Robertson | 114/362 |
| 5,287,945 | 2/1994 | Thurlow | 182/97 |
| 5,301,630 | 4/1994 | Genovese | 114/375 |

*Primary Examiner*—Jesus D. Sotelo

*Attorney, Agent, or Firm*—Mark G. Sandbaken; Daniel P. McCarthy

[57] ABSTRACT

A recreational and emergency ladder for use with watercraft, the ladder having side supports, rungs and an attachment mechanism. The ladder assists the user to reenter a watercraft without the assistance of another person. The ladder may be stored in a collapsed state and is prevented from being accidentally released by a releasable fastening mechanism. The ladder may further comprise a container for holding the ladder when the ladder is not is use.

31 Claims, 6 Drawing Sheets

RECREATIONAL AND EMERGENCY LADDER FOR WATERCRAFT

BACKGROUND OF THE INVENTION

1. Field of the Invention

This invention relates to the field of devices which facilitate entry and exit of watercraft. More specifically, this invention relates to the field of devices which assist a person in the water to reenter the watercraft.

2. Description of Related Art

Boating on rivers is a recreational activity which is becoming increasingly popular. For example, one of the thrills of whitewater river boating is the challenge of maneuvering a watercraft through stretches of rapids. It is not uncommon for passengers to fall out of or be thrown out of a boat while traversing the rapids. It is also pleasurable to enjoy quiet stretches of a river by swimming or diving from a boat. The watercraft typically used for boating may include inflatable rafts, dories, aluminum fishing boats, catarafts, pontoons, kayaks and canoes.

It is often difficult for a person in the water to reenter a watercraft without the assistance of a person in the craft. Watercraft may have high sides which may be very slippery when wet. This is particularly true of inflatable watercraft which are used when traversing whitewater. It is not uncommon for persons in the water to require the assistance of other passengers when reentering the watercraft. Solo boaters have a particularly difficult problem as there is no one to assist them to reenter the boat.

One method for assisting people out of the water is to throw them a line and pull the person to the boat. The person in the water then either pulls themself into the boat or is helped into the boat by a passenger. A disadvantage of this method is that it requires the assistance of a person in a boat, and, therefore, this method is not suitable for solo boaters. This method is also not suitable for rescuing persons while traversing rapids when passengers in the craft must steer or row to avoid water hazards. A line trailing from a boat is also likely to become snagged, which may cause the person holding the line to be pulled overboard.

U.S. Pat. No. 5,301,630, issued Apr. 12, 1994, discloses an inflatable rescue ramp for reentering watercraft. This patent is incorporated by reference in its entirety. The ramp creates a large protrusion from the side of the watercraft. Such a ramp is not suitable for use while boating through whitewater as its large size may cause it to snag on water hazards. Such a large protrusion also makes the watercraft very difficult to maneuver. The ramp is also not readily accessible in an emergency, as the ramp must be inflated before use.

U.S. Pat. No. 5,074,236, issued Dec. 24, 1991, discloses a ladder system with a flexible ladder and a separate canister. The ladder is released by pulling on a lanyard attached to the canister. This patent is incorporated by reference in its entirety. The ladder is attached to a point on the boat, and the canister is separately attached to a boat railing. Thus, three attachment points are required on the boat. Such a design creates numerous hazards for the whitewater boater as the lanyard extending from the canister may catch on a water hazard, accidentally releasing the ladder and creating a greater hazard. Some watercraft also typically do not have railings from which such a canister could be hung. The canister is preferably made of plastic, and the size and hardness of the canister is a further problem because the canister could create a hazard for persons in the watercraft, cause injury to a passenger, catch on a water hazard or, if crushed, puncture the sides of an inflatable watercraft. If the canister is mounted inside the boat, the ladder may not be readily accessible by persons who wish to reenter the watercraft. Such a ladder unit may also not allow access to the craft when the craft is overturned.

U.S. Pat. No. 4,811,817, issued Mar. 14, 1989, discloses a hidden ladder unit mounted in the stern of a hard-hulled boat. The ladder unit is disposed in a housing having a front door. This patent is incorporated by reference in its entirety. A difficulty with such a hidden ladder unit is that the unit cannot be mounted onto an inflatable watercraft. Thin walled or single walled watercraft also may not have sufficient room for the housing of the ladder unit to be mounted to the boat without creating a protrusion on the inside or outside of the boat hull. If the housing is mounted inside the boat, the ladder may not be readily accessible by persons who wish to reenter the watercraft, and the housing may create a hazard for passengers and may cause injury. If the housing is mounted on the outside of the hull, it may catch on a water hazard or interfere with persons trying to reenter the boat. The housing could also puncture an inflatable watercraft.

U.S. Pat. No. 5,287,945, issued Feb. 22, 1994, discloses a ladder for an inflatable boat which is supported by a flexible saddle. The ladder is made from rigid plastic and has a T-shaped structure which projects outward from the boat when in use. When the ladder is retracted, it projects transverse to the edge of the boat. Such a hard ladder also be a hazard for passengers when boating and may not allow access to the boat when the boat is overturned.

The instant invention of a collapsible recreational and emergency ladder is readily accessible from the outside of a watercraft and may be quickly deployed in an emergency. A releasable fastening mechanism prevents the ladder from being accidentally deployed. The size and shape of the ladder may be adjusted to suit different types, sizes and styles of watercraft, including inflatable watercraft. The ladder may optionally be stored in a soft-sided container which protects the ladder from being accidentally deployed and which provides a cushion between the ladder and passengers or the side of the craft.

SUMMARY OF THE INVENTION

It is an object of the invention to provide a recreational and emergency ladder for watercraft which will assist the user to reenter the craft. It is a feature of the invention that the size of the ladder may be varied to facilitate access to a variety of watercraft. It is an advantage of the invention that the ladder is lightweight and readily mounted on a watercraft. It is a further advantage of the invention that the ladder is inexpensive to manufacture and may be made from a variety of materials to suit the desired use of the ladder.

It is an object of the invention to provide a recreational and emergency ladder for watercraft which will allow a person outside the watercraft to enter the craft without assistance. It is a feature of the invention that the ladder can be readily deployed by a solo boater. It is an advantage of the invention that the ladder is strong and light-weight and yet simple to deploy so that it can be used by persons of all ages. It is a further advantage of the invention that the ladder can be used to climb onto the top of an overturned watercraft.

It is an object of the invention to provide a recreational and emergency ladder which is compact, easily stored and readily released when needed. It is a feature of the invention that the ladder is compact when stored and is prevented from being accidentally released by a releasable fastening mechanism. It is an advantage of the invention that the ladder may be stored in a light-weight, soft-sided container which prevents injuries to passengers in the watercraft. It is also an advantage of the invention that the soft-sided container prevents damage to the watercraft. It is a further advantage of the invention that when the ladder is stored in a container, while the ladder is readily accessible to persons in the water, the container prevents the ladder from becoming snagged on water hazards.

It is an object of the invention to provide a recreational and emergency ladder that is readily attached to a watercraft. It is a feature of the invention that the ladder may be attached to a variety of attachment points on watercraft. It is an advantage of the invention that the ladder is portable and may be quickly shifted from one position in the craft to another. It is a further advantage of the invention that the ladder requires only a single attachment point. It is a further advantage of the invention that the invention may be used with inflatable watercraft.

These and other objects, features and advantages of the invention will be clear to a person of ordinary skill in the art upon reading this specification in light of the appended drawings.

BRIEF DESCRIPTION OF THE DRAWINGS

DETAILED DESCRIPTION OF THE PREFERRED EMBODIMENTS a. The Recreational and Emergency Ladder Referring to FIG. 1, in a preferred embodiment of the invention, recreational and emergency ladder 100 includes side supports 101*a* and 101*b*, rungs 102 and attachment mechanism 103. Side supports 101*a* and 101*b* may be made from any suitable flexible material providing sufficient strength to support a user. Suitable flexible materials for side supports 101*a* and 101*b* may include a synthetic webbing such as nylon or polypropylene, rope, or cloth. In the most preferred embodiment of the invention, the side supports are made of a webbing. The ladder 100 may include any suitable number of rungs 102, ranging from 1 to 10 or more rungs. FIG. 1 shows a ladder 100 having 3 rungs 102*a*, 102*b* and 102*c*. The number of rungs may be varied according to the desired use of the ladder and the height or size of the watercraft with which the ladder is used. A rung 102 may be made from the same material as side supports 101*a* and 101*b*. A rung 102 may also be made from different materials which are securely attached to side supports 101*a* and 101*b*, so that the rungs will support the weight of a person using the ladder. In the most preferred embodiment of the invention, rungs 102 may be strengthened by adding reinforcement 106. Note that rung 102*a* is shown by hidden lines because reinforcement 106*a* is overlaid on top of rung 102*a*. A reinforcement 106 for rung 102 may include a rigid tube or board including but not limited to plastic pipe made from PVC tubing, hardwood, marine wood, molded plastic, rubber, HYPALON, marine plywood and aluminum tubing.

Ladder 100 further includes at least one attachment mechanism 103, which may be used to attach the ladder 100 to a watercraft. Referring to FIGS. 1–5, an attachment mechanism 103 may include a loop of flexible material 103*a* extending from side support 101, a clip, snap or carabiner 103*b* attached to side support 101, or other similar mechanism. Attachment mechanism 103 may also be a loop of flexible material, or a clip or snap or other similar mechanism extending from a rung 102 or reinforced rung combination 102/106.

Referring to FIG. 4, the attachment mechanism may be attached to an attachment point on a watercraft 450 such as a D-ring 402*a*, an eye 402*b*, a cleat 402*c*, a frame 402*d* or other attachment point which will support the weight of a person using the ladder. The attachment mechanism may further include a carabiner to connect the ladder to the watercraft. The attachment mechanism could also be attached to a piece of webbing extended between two attachment points on the watercraft. If desired, more than one attachment mechanism could be used to secure the ladder to the watercraft.

In a more preferred embodiment of the invention, the side supports 101 or rungs 102 of the ladder 100 are buoyant, so that the ladder floats on the surface of the water. This allows the ladder to be readily seen after being deployed.

Figure 5:
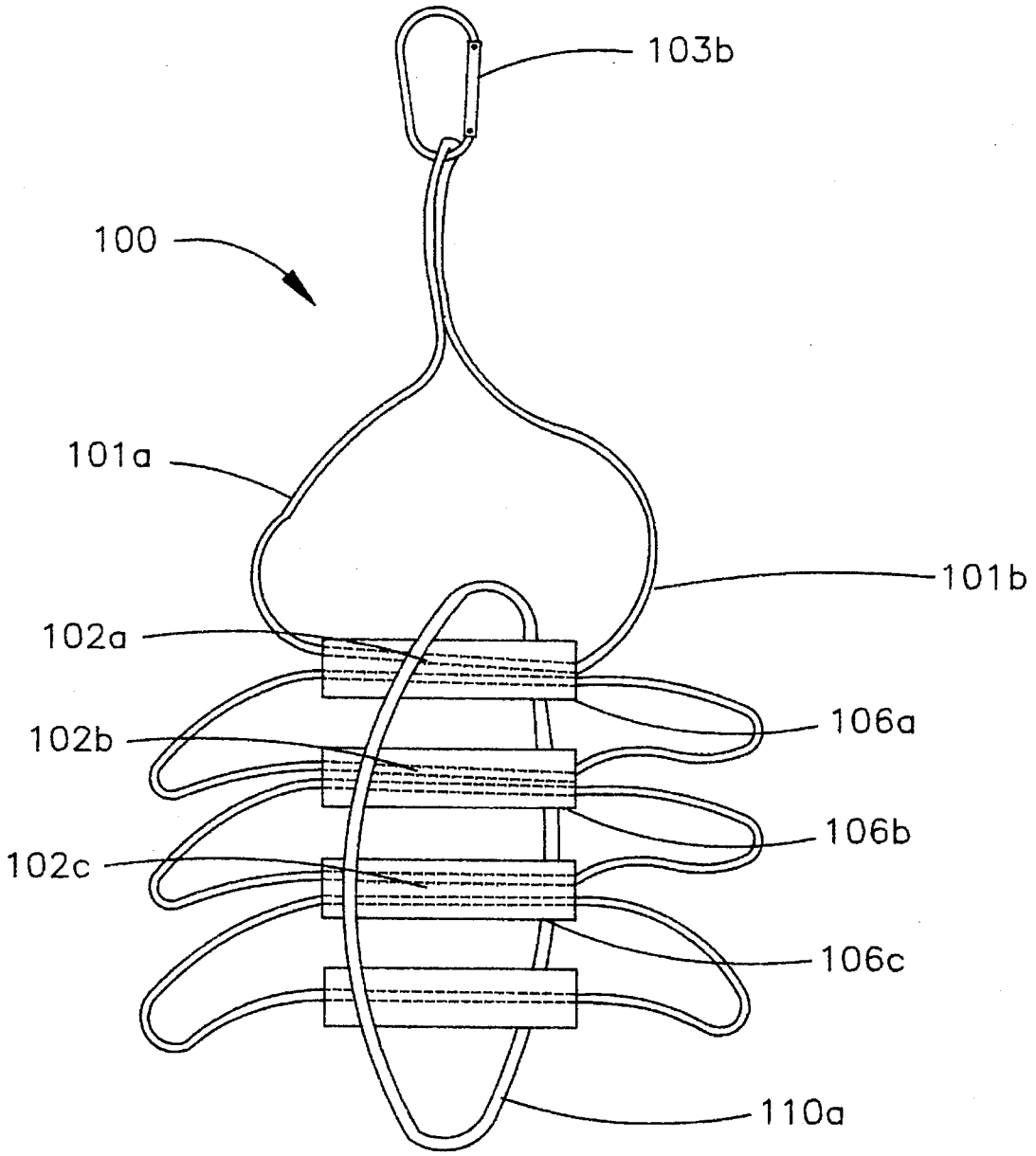
FIG. 5 depicts another preferred embodiment of the ladder.

Ladder 100 is preferably compactly stored when not in use. Referring to FIG. 5, ladder 100 may be secured using a releasable fastening mechanism 110 such as a rope, string, fabric, or plastic piece tied, clipped, snapped or buttoned around the ladder. FIG. 5 shows a releasable fastening mechanism 110*a* comprising a fabric tie with a releasable snap. A drawstring may also be used to secure the stored ladder. The releasable fastening mechanism prevents the ladder from being entangled in water hazards when the ladder is not in use. In the preferred embodiment of the invention, the releasable fastening mechanism is readily released by a person in the water.

The ladder may also be stored in a releasable fastening mechanism such as container 104. A container, as used herein, refers to a receptacle which will hold the ladder when the ladder is not in use. The container prevents the ladder from becoming entangled in water hazards while the ladder is not in use. The container may be made from any suitable material which will resist tearing or abrasion, allow the material to dry quickly or prevent the material from rotting or mildewing. In the most preferred embodiment of the invention, the container is a bag made of a natural or synthetic fabric which has soft-sides to prevent injury to passengers or damage to the watercraft. Suitable fabrics for the container may include, but are not limited to, nylon, polypropylene, ballistic nylon, cotton, polyester, CORDURA, acrylic canvas (such as that sold under the tradename SUNBRELLA by Glen Raven Mills), mesh, netting, 60/40 fabric, and natural or synthetic fabrics. In a preferred embodiment of the invention, the container may be treated with a water-repellant compound or a compound to help the fabric resist rotting and mildewing.

In the preferred embodiment of the invention, container 104 may be readily opened by a person in the water. Container 104 may further include a snap, a button and hole, a sliding fastener and drawstring, a clip or string inserted through two holes in the container or equivalent mechanism for releasably securing the container in a closed condition.

In the most preferred embodiment of the invention, the container includes a drawstring and sliding fastener 105.

In the best mode of the invention contemplated by the inventor, the side supports and rungs of the ladder are made from 1" wide webbing (nylon and/or polypropylene). The ladder is formed by sewing together three separate loops of webbing, where the sections of webbing which are sewn together form the rungs. The rungs are thus formed of triple thicknesses of webbing, due to the overlap of the webbing. The rungs are reinforced with rigid PVC plastic pipe, which also serves to protect the seams from wear and abrasion. A loop of webbing at one end of the side supports forms an attachment mechanism. The end of the ladder having the attachment mechanism extends through an aperture in the closed end of a nylon bag (packcloth), and the fabric adjacent to the aperture is sewn to the nylon webbing. The container has a water repellant finish. A carabiner is used to attach the loop at one end of the ladder to a watercraft.

b. Method of Making the Recreational and Emergency Ladder

The recreational and emergency ladder may be made in sections or formed from a single piece of material. In one preferred embodiment of the invention, side supports 101 may be made from a single piece of flexible material. Alternately, in another preferred embodiment of the invention, the ladder may be formed from a series of pieces of flexible material. In either embodiment of the invention, the flexible material may be attached by sewing, tying, gluing, stapling, clipping, or equivalent methods. Rungs may be formed by attaching pieces of flexible material between side supports using any of the methods described above. Rungs may also be made by forming loops of flexible material and then attaching the loops together using any of the methods described above. If reinforcements are used to strengthen the rungs, the reinforcement pieces may be applied to the flexible material either before or after the ladder is formed.

An attachment mechanism may be formed by sewing, tying, gluing, stapling, clipping, or equivalent methods, one or more pieces of flexible material to form a single piece or a loop of flexible material at one end of the ladder. An attachment mechanism such as a clip, snap or carabiner may also be attached to the flexible material by any of the methods described above.

Figure 1:
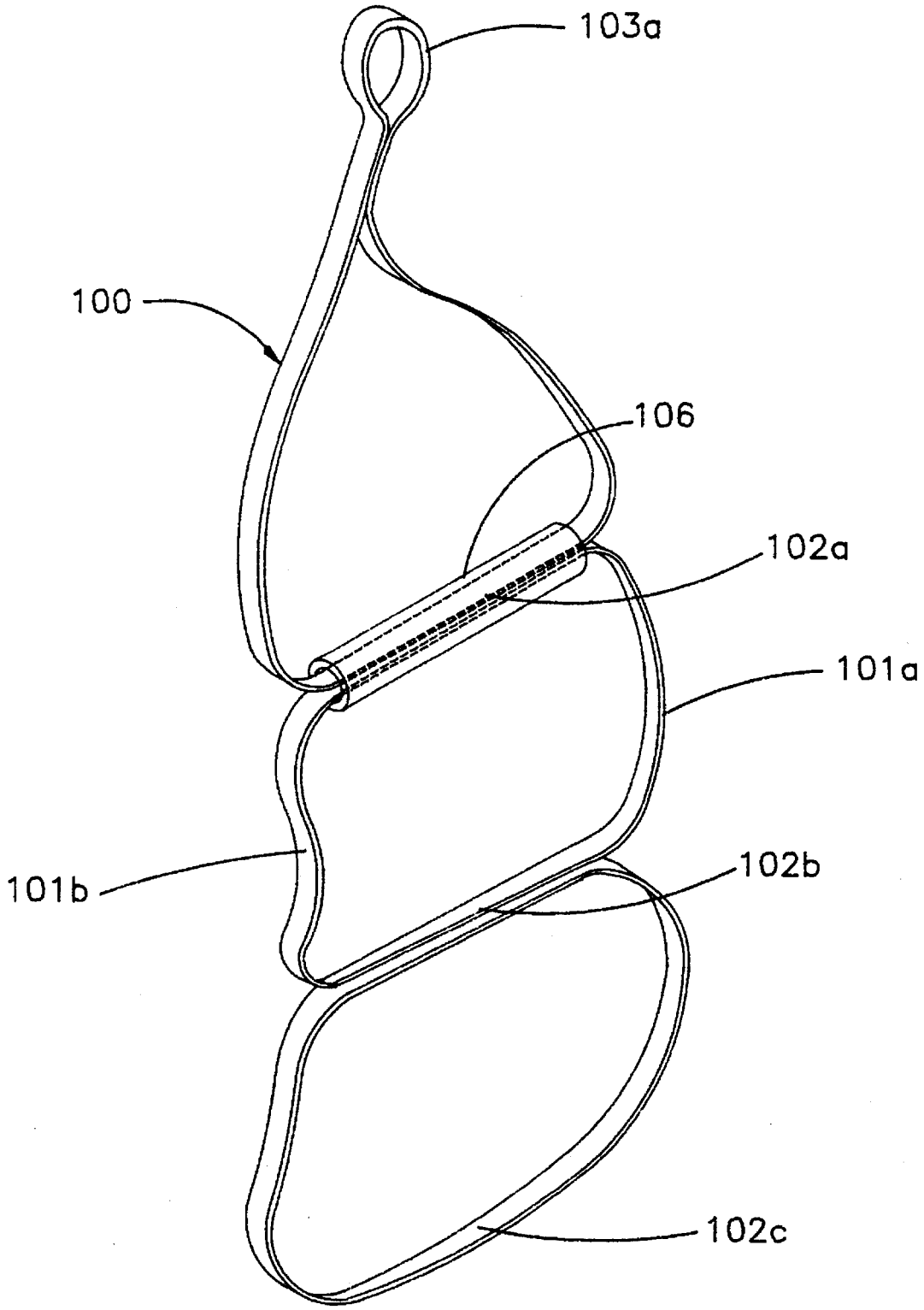
FIG. 1 depicts a preferred embodiment of the recreational and emergency ladder in the fully deployed position.
Figure 2:
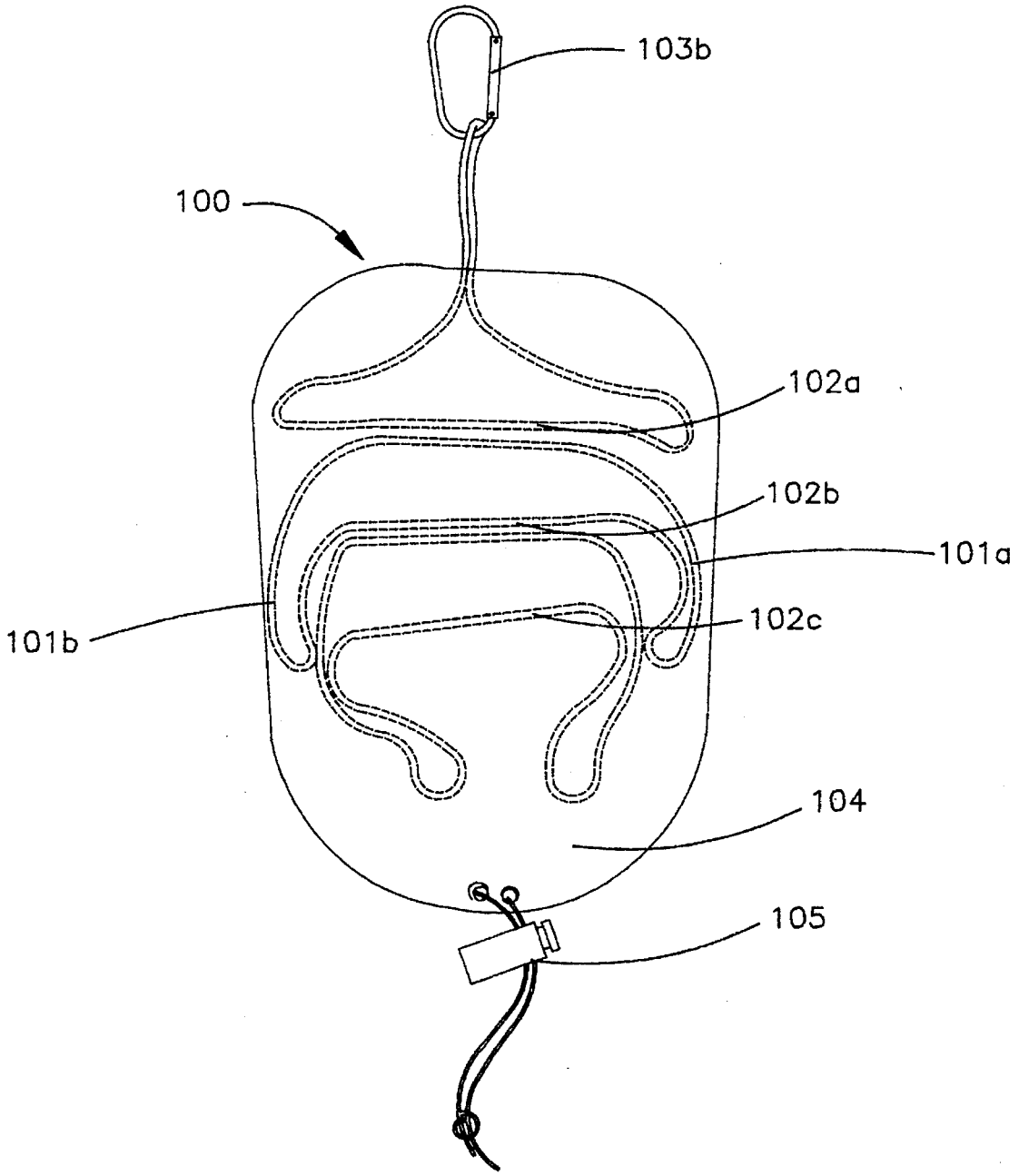
FIG. 2 depicts a preferred embodiment of the ladder when stored.
Figure 2B:
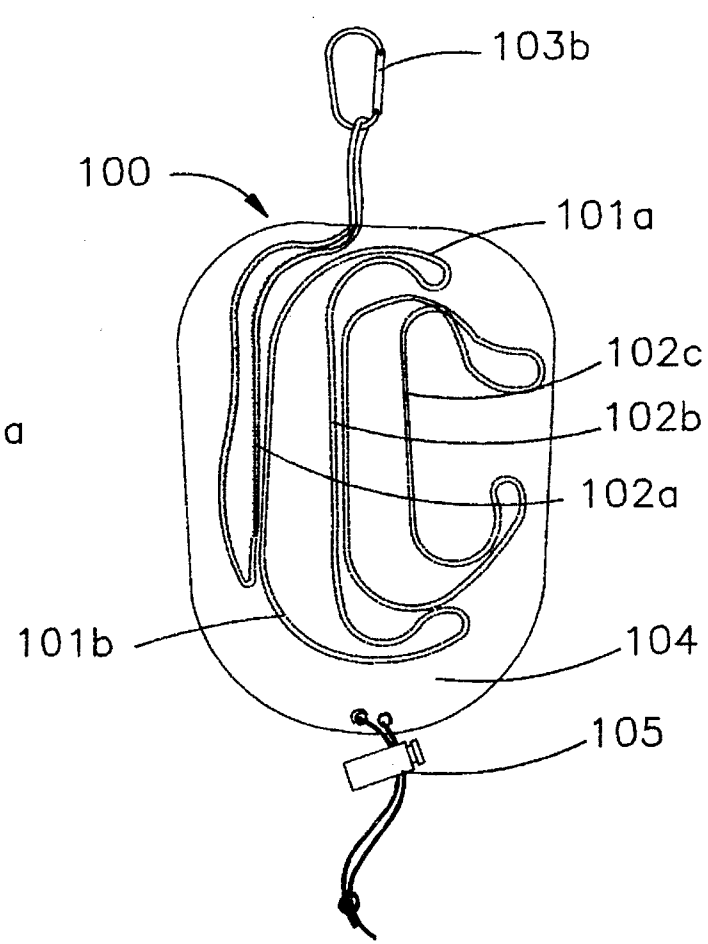
Figure 2A:
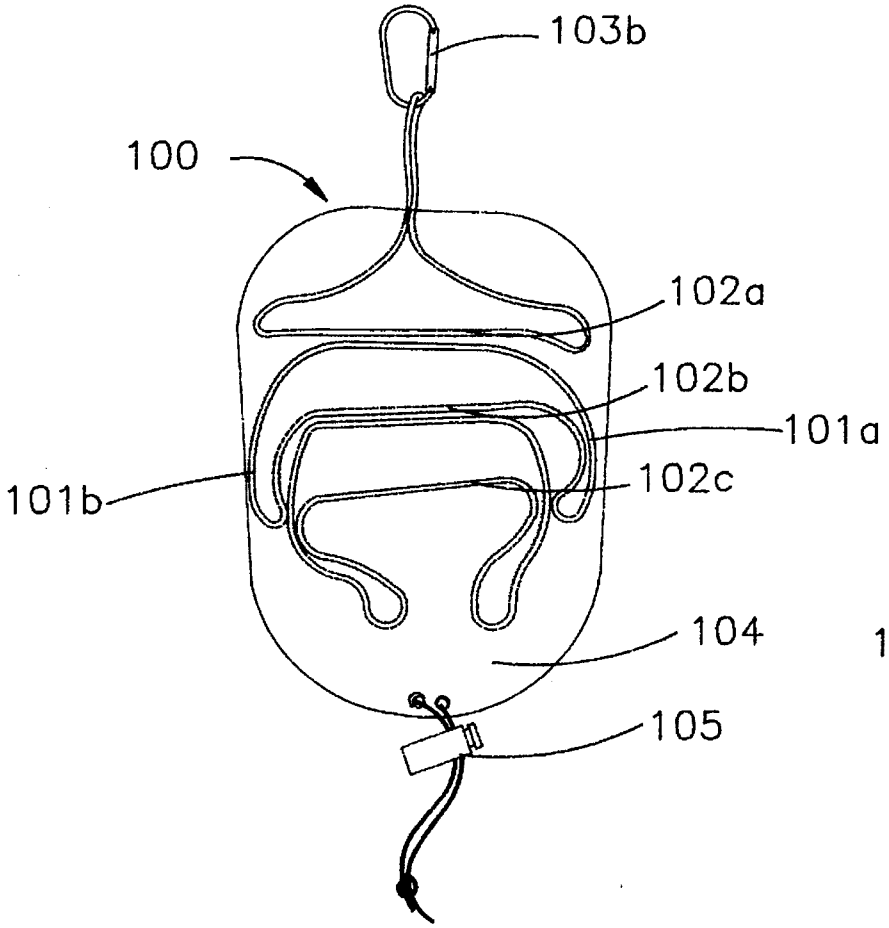

In a preferred embodiment of the invention in which the ladder is to be stored in a container, the container is preferably attached to the side supports by any of the methods described above. The end of the ladder having an attachment mechanism may also project through the closed end of such a container. In this embodiment of the invention, as shown in FIG. 1, the side supports are contiguous with the end having an attachment mechanism. When a user applies tension to the ladder, tension is not applied to the container. In other preferred embodiments of the invention, a sufficiently strong container may be incorporated as part of the side supports and may be used to provide support for a user.

c. Method of Using the Recreational and Emergency Ladder

Figure 4:
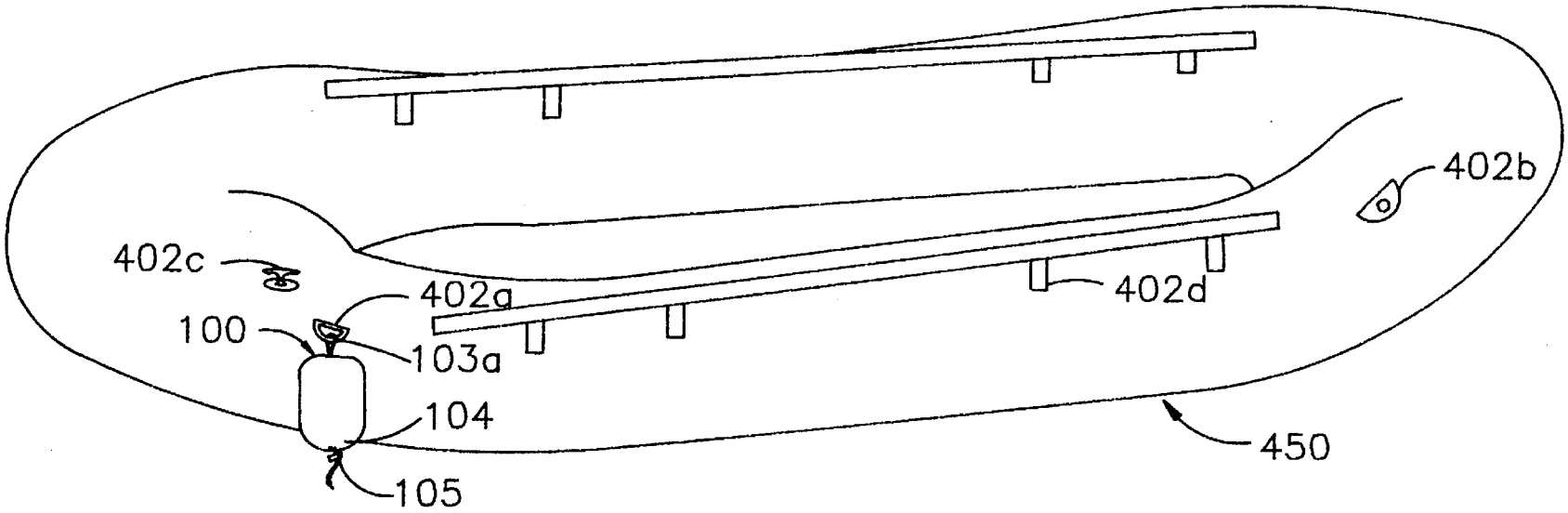
FIG. 4 depicts a preferred embodiment of the ladder attached to the side of a boat.

Referring to FIG. 4, the ladder is preferably attached to an attachment point 402 on a watercraft 450 such as a D-ring 402*a*, eye 402*b*, cleat 402*c*, frame 402*d* or other structure which will support the weight of a person using the ladder. This structure may be positioned on the top or outside of the watercraft. The length of the side supports of the ladder may be adjusted so that the ladder, in a stored position, may be reached by a person in the water. Upon releasing a releasable fastening mechanism, the ladder is deployed so that a user can climb up the ladder.

The ladder may also be deployed when the watercraft is overturned or at an angle. Climbing onto the top of an overturned raft is important in order to be able to properly right the craft. Upon releasing a releasable fastening mechanism, the ladder is deployed so that the user can climb up the ladder and onto the bottom of the watercraft or into the watercraft. The length of the side supports of the ladder may be adjusted so that the ladder is accessible to a person in the water whether the watercraft is right-side up or upside down. Because the ladder is readily moved between attachment points on the watercraft, the position of the ladder may be readily changed to allow easier or safer access to the craft whether the craft is right-side up, upside down or at an angle.

Figure 3:
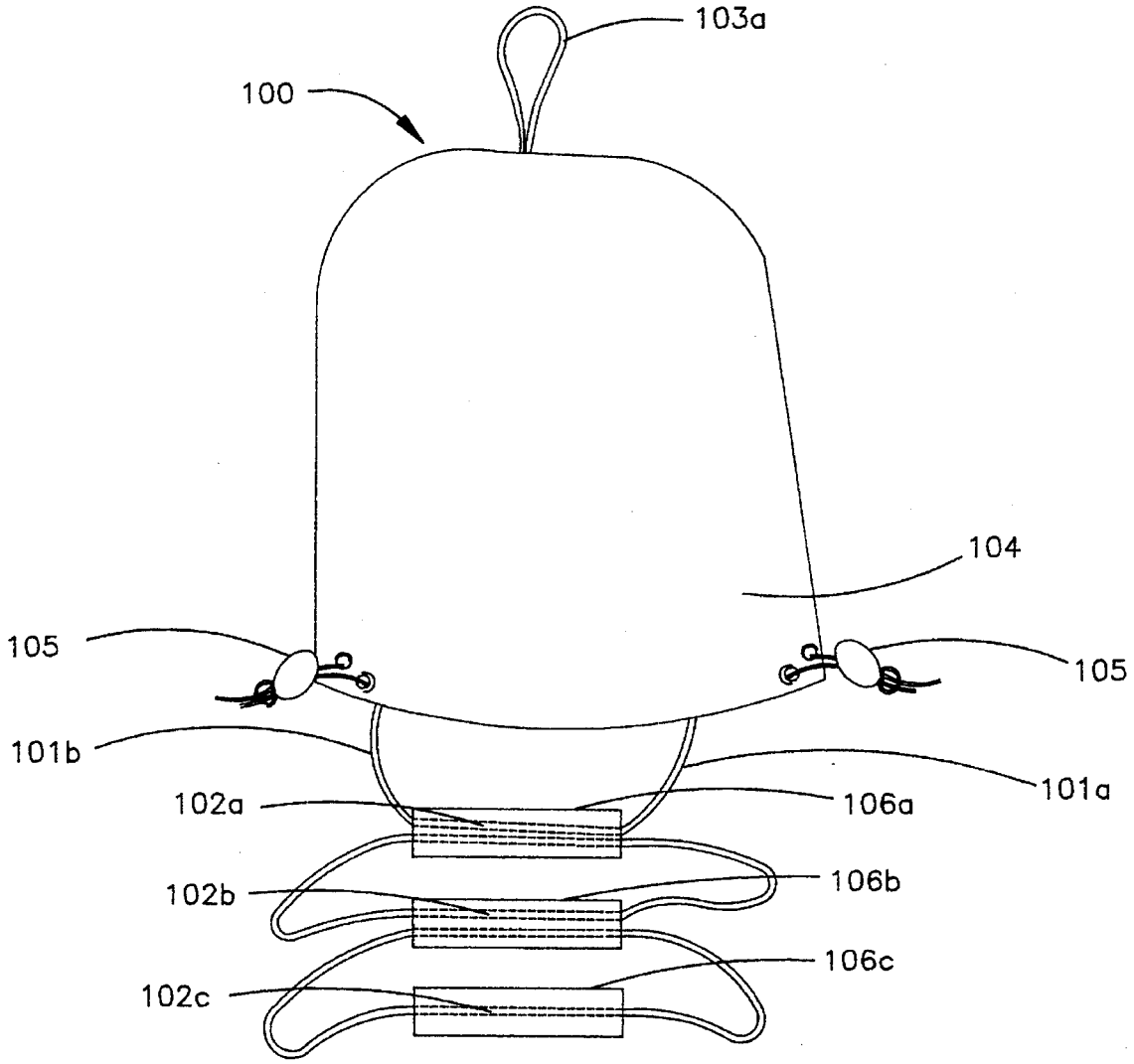
FIG. 3 depicts a preferred embodiment of the ladder in a partially stored position.

When the ladder is to be stored, the ladder is quickly and easily gathered up rung by rung, beginning with the bottom rung. FIG. 3 shows a ladder in a partially stored position. A releasable fastening mechanism may then be attached to the collapsed ladder. Alternatively, the collapsed ladder may be placed in a container.

While the present invention has been described and illustrated in conjunction with a number of specific embodiments, those skilled in the art will appreciate that variations and modifications may be made without departing from the principles of the invention as herein illustrated, described and claimed.

The invention may be embodied in other specific forms without departing from the spirit or essential characteristics thereof. The present embodiments are to be considered in all respects as illustrative, and not restrictive. The scope of the invention, is therefore, indicated by the appended claims rather than by the foregoing description, and all changes which come within the meaning and range of equivalency of the claims are to be embraced within their scope.

I claim:

1. A recreational and emergency device for assisting a person to reenter a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a releasable fastening mechanism, said fastening mechanism being disposed about said device when said device is stored in a collapsed condition, said releasable fastening mechanism being adapted to allow said ladder to be quickly deployed when needed;

wherein said side supports and said at least one rung comprise a webbing.

2. A device according to claim 1, wherein said at least one rung further comprises a reinforcement.

3. A device according to claim 1, wherein said releasable fastening mechanism comprises a container, said container being arranged about the ladder so that said attachment mechanism may be used to attach the ladder within its container to a watercraft, said container being attached to at least one of said side supports, and said container being capable of being closed.

4. A device according to claim 3, wherein said container comprises a fabric.

5. A device according to claim 4, wherein said fabric is selected from the group consisting of nylon, polypropylene, polyester, cotton, ballistic nylon, polyester, CORDURA, acrylic canvas, mesh, netting and 60/40 fabric.

6. A recreational and emergency device for assisting a person to reenter a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a releasable fastening mechanism, said fastening mechanism being disposed about said device when said device is stored in a collapsed condition, said releasable fastening mechanism being adapted to allow said ladder to be quickly deployed when needed;

wherein said at least one rung further comprises a reinforcement.

7. A device according to claim 6, wherein said releasable fastening mechanism comprises a container, said container being arranged about the ladder so that said attachment mechanism may be used to attach the ladder within its container to a watercraft, said container being attached to at least one of said side supports, and said container being capable of being closed.

8. A device according to claim 7, wherein said container comprises a fabric.

9. A device according to claim 8, wherein said fabric is selected from the group consisting of nylon, polypropylene, polyester, cotton, ballistic nylon, polyester, CORDURA, acrylic canvas, mesh, netting and 60/40 fabric.

10. A device according to claim 6, wherein said side supports comprise a webbing.

11. A device according to claim 6, wherein said at least one rung comprises a webbing.

12. A recreational and emergency device for assisting a person to reenter a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a releasable fastening mechanism, said fastening mechanism being disposed about said device when said device is stored in a collapsed condition, said releasable fastening mechanism being adapted to allow said ladder to be quickly deployed when needed;

wherein said releasable fastening mechanism comprises a container, said container being arranged about the ladder so that said attachment mechanism may be used to attach the ladder within its container to a watercraft, said container being attached to at least one of said side supports, and said container being capable of being closed; and wherein said container comprises a fabric.

13. A device according to claim 12, wherein said fabric is selected from the group consisting of nylon, polypropylene, polyester, cotton, ballistic nylon, polyester, CORDURA, acrylic canvas, mesh, netting and 60/40 fabric.

14. A recreational and emergency device for assisting a person into a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a container into which the ladder is placable for storage when not in use and from which the ladder may be quickly deployed when needed, said container being arranged about the ladder so that the attachment mechanism may be used to attach the ladder within its container to a watercraft; and wherein said side supports and said at least one rung comprise a webbing.

15. A device according to claim 14, wherein said at least one rung further comprises a reinforcement.

16. A device according to claim 14, wherein said container comprises fabric.

17. A device according to claim 16, wherein said fabric is selected from the group consisting of nylon, polypropylene, polyester, cotton, ballistic nylon, polyester, CORDURA, acrylic canvas, mesh, netting and 60/40 fabric.

18. A device according to claim 14, wherein said container is attached to at least one of said side supports, and said container being capable of being closed.

19. A recreational and emergency device for assisting a person into a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a container into which the ladder is placable for storage when not in use and from which the ladder may be quickly deployed when needed, said container being arranged about the ladder so that the attachment mechanism may be used to attach the ladder within its container to a watercraft; and wherein said at least one rung further comprises a reinforcement.

20. A device according to claim 19, wherein said at least one rung further comprises a reinforcement.

21. A device according to claim 19, wherein said container comprises fabric.

22. A device according to claim 21, wherein said fabric is selected from the group consisting of nylon, polypropylene, polyester, cotton, ballistic nylon, polyester, CORDURA, acrylic canvas, mesh, netting and 60/40 fabric.

23. A device according to claim 19, herein said side supports comprise a webbing.

24. A device according to claim 19, wherein said at least one rung comprises a webbing.

25. A device according to claim 19, wherein said container is attached to at least one of said side supports, and said container being capable of being closed.

26. A recreational and emergency device for assisting a person into a watercraft comprising:

an elongate and flexible first side support having a first end and a second end;

an elongate and flexible second side support having a first end and a second end, said first end of said first side support and the first end of said second side support being firmly joined to each other;

at least one elongate rung, each rung having a first end and a second end, the first end of each rung being firmly joined to said first side support, and the second end of each rung being joined to said second side support;

an attachment mechanism secured at said first ends of said side first and second side supports, the attachment mechanism being adapted for use in suspending the ladder from a watercraft; and a container into which the ladder is placable for storage when not in use and from which the ladder may be quickly deployed when needed, said container being arranged about the ladder so that the attachment mechanism may be used to attach the ladder within its container to a watercraft;

wherein said container is attached to at least one of said side supports, and said container being capable of being closed; and wherein said container comprises fabric.

27. A device according to claim 26, wherein said fabric is selected from the group consisting of nylon, polypropylene, polyester, cotton, ballistic nylon, polyester, CORDURA, acrylic canvas, mesh, netting and 60/40 fabric.

28. A device according to claim 26, wherein said at least one rung further comprises a reinforcement.

29. A device according to claim 26, wherein said side supports comprise a webbing.

30. A device according to claim 26, wherein said at least one rung comprises a webbing.

31. A recreational and emergency device for aiding a person out of the water and into a watercraft comprising:

an elongate and flexible first side support having a first end and a second end;

an elongate and flexible second side support having a first end and a second end, the first end of said first side support and the first end of said second side support being firmly joined to each other;

at least one elongate rung, each rung having a first end and a second end, the first end of each rung being firmly joined to said first side support, and the second end of each rung being joined to said second side support;

a rigid reinforcement disposed about said at least one rung;

an attachment mechanism secured at said first ends of said side first and second side supports, the attachment mechanism being adapted for use in suspending the ladder from a watercraft; and a container into which the ladder is placable for storage when not in use and from which the ladder may be quickly deployed when needed, said container comprising a fabric, said container having a closed end and an open end, said closed end having an aperture so that the attachment mechanism may be used to attach the ladder within its container to a watercraft;

wherein said side supports and said at least one rung comprise webbing;

wherein said side supports pass through said open end and said aperture of said closed end of said container; and wherein said container is attached to at least one of said side supports.

* * * * *